US009987565B2

(12) United States Patent
Coronas Coma et al.

(10) Patent No.: US 9,987,565 B2
(45) Date of Patent: Jun. 5, 2018

(54) CRYING DOLL

(71) Applicant: IMC TOYS, S.A., Terrassa (ES)

(72) Inventors: Ivan Coronas Coma, Terrassa (ES); Victor Gil Garcia, Terrassa (ES)

(73) Assignee: IMC TOYS, S.A., Terrassa (ES)

( * ) Notice: Subject to any disclaimer, the term of this patent is extended or adjusted under 35 U.S.C. 154(b) by 0 days. days.

(21) Appl. No.: 15/492,623

(22) Filed: Apr. 20, 2017

(65) Prior Publication Data

US 2017/0304737 A1 Oct. 26, 2017

(30) Foreign Application Priority Data

Apr. 21, 2016 (ES) ..... 201630493

(51) Int. Cl.

| | |
|---|---|
| ***A63H 3/24*** | (2006.01) |
| ***A63H 3/38*** | (2006.01) |
| ***A63H 3/28*** | (2006.01) |
| *A63H 3/20* | (2006.01) |

(52) U.S. Cl.
CPC ..... *A63H 3/24* (2013.01); *A63H 3/28* (2013.01); *A63H 3/38* (2013.01)

(58) Field of Classification Search
CPC ..... A63H 3/20; A63H 3/24; A63H 3/365
USPC ..... 446/304–306
See application file for complete search history.

(56) References Cited

U.S. PATENT DOCUMENTS

| | | | | |
|---|---|---|---|---|
| 962,154 A | | 6/1910 | Lemor | |
| 2,959,890 A | * | 11/1960 | Ostrander | A63H 3/24 446/183 |
| 3,053,009 A | * | 9/1962 | Ostrander | A63H 3/20 446/306 |
| 3,193,968 A | * | 7/1965 | Brudney | A63H 3/24 446/306 |
| 3,445,955 A | * | 5/1969 | Mucciante | A63H 3/24 446/183 |
| 3,745,696 A | | 7/1973 | Sapkus et al. | |
| 3,758,983 A | * | 9/1973 | Cagen | A63H 3/24 446/306 |
| 3,789,539 A | * | 2/1974 | Cagen | A63H 3/24 446/306 |

(Continued)

FOREIGN PATENT DOCUMENTS

| | | |
|---|---|---|
| CN | 203400496 U | 1/2014 |
| EP | 1864703 A1 | 12/2007 |

OTHER PUBLICATIONS

Communication dated Aug. 16, 2017 from the European Patent Office in counterpart European application No. 17 38 2200.

*Primary Examiner* — Kien Nguyen
(74) *Attorney, Agent, or Firm* — Sughrue Mion, PLLC

(57) ABSTRACT

A crying doll having a head with eyes, each endowed with a tear hole, a mouth, a device housed in the head for producing the visual effect of the doll shedding tears that has a fluid tank connected to the outside and able to accumulate a fluid above the level of the tear holes, and at least one flexible supply duct that hydraulically connects with one or both of the tear holes. The device includes a throttle for the supply duct and an actuating cam for the throttle for arranging the throttle against the supply duct, flattening it locally and impeding the passage of fluid through it. The actuating cam is mounted in the proximity of the mouth and operable upon inserting a nipple of an accessory element, separate or not from the doll, in the mouth.

17 Claims, 4 Drawing Sheets

(56) References Cited

U.S. PATENT DOCUMENTS

| | | | | | |
|---|---|---|---|---|---|
| 3,841,020 | A * | 10/1974 | Ryan | A63H 3/24 | 446/190 |
| 4,033,071 | A * | 7/1977 | Strongin | A63H 3/24 | 446/177 |
| 4,074,460 | A * | 2/1978 | Thorn | A63H 3/24 | 446/304 |
| 5,083,965 | A * | 1/1992 | Mayem | A63H 3/24 | 446/297 |
| 5,094,644 | A * | 3/1992 | Kelley | A63H 3/24 | 200/83 B |
| 6,042,450 | A * | 3/2000 | Leversedge | A63H 3/365 | 446/304 |
| 7,744,442 | B2 * | 6/2010 | Rettberg | A63H 3/365 | 446/301 |

* cited by examiner

CRYING DOLL

TECHNICAL FIELD OF THE INVENTION

The invention relates to a crying doll, the kind that incorporates a device for producing the visual effect of the doll crying, in other words, that it spills tears from its eyes.

BACKGROUND OF THE INVENTION

Currently, there are various proposals of dolls that carry out various actions as a response to some external stimulus. Such is the case with dolls that comprise means or devices that make the doll able to spill water from its eyes.

These proposals are all based on housing a water tank inside the doll, but they differ according to the mechanisms that accompany the tank to assure that the contained water is spilled from the eyes of the doll.

For example, the proposal in document ES0149711 U is known, which describes a doll with an apparatus for simulating the appearance of tears in the eyes of a doll that has a vessel with an outlet hole to which a duct connects that guides the fluid from the tank to an opening made in the eye of the doll. In the outlet hole of the tank a valve member is mounted that can be turned to one of two positions, in one of which the outlet hole is closed and the other in which the outlet hole is open. The control for the position of the valve member is activated remotely through magnetic means. To this end the valve member comprises an electromagnet that can be rotated by means of a control magnet that can be grasped from outside the doll with one hand, such that a user can make the doll "cry" by simply handling the control magnet close to the head of the doll. In this case, it is not necessary to endow the doll with pumping or similar means for propelling the fluid contained in the tank towards the eyes.

Another example is that described in the document ES0181861 U, which describes a doll that comprises a liquid tank mounted inside its head; a duct that connects the tank to the eyes in order to create a passage intended to move the fluid from its tank to the eyes of the doll in order to produce the visual effect of a doll that cries; a flexible ampule that extends downward from said tank and into the body of the doll; and a cantilever that goes from the outside of the doll to its body and that is arranged in a way that upon moving, it compresses the ampule and moves the fluid contained in it to the outside through the duct, producing a tearing effect. In this case, the cantilever carries out a function similar to that of pumping or propelling means for the fluid contained in the tank.

An objective of the invention is an alternative device for ensuring that a fluid contained in the doll can flow through its eyes in order to produce the effect of the doll crying.

With the goal of improving the playability of the doll, another objective of the invention is that the "crying" effect of the doll can be controlled by the user, and more specifically by simulating an action associated with a typical comforting action in real life, such as feeding or placing a pacifier or similar object in the mouth of a baby.

Another objective of the invention is that the control device for the "crying" be constructively simple but robust at the same time.

Likewise, another objective of the invention is a device suitable for ensuring a dripping effect, in this way better simulating shedding tears.

To this end it is not desirable, for example, for water flow to be expelled in such a way that, upon leaving the tear hole, it sprays continuously instead of dripping.

It is also desirable that this device can function without needing to have pumping or other similar means in order to cause the crying, such that the fluid contained in the tank can be emptied naturally, without having to propel the circulation of the fluid from said tank to the eyes of the doll.

DESCRIPTION OF THE INVENTION

The crying doll object of the present invention comprises a head in which two eyes are provided, each one endowed with a tear hole, and a mouth, a device being housed in the head for producing the visual effect of the doll shedding tears, in other words, that it spills tears from its eyes.

The device comprises a fluid tank connected to the outside and able to accumulate a fluid above the level of the tear holes; and at least one flexible supply duct that hydraulically connects said tank to one or to both of the tear holes.

Essentially, the doll is characterized in that it further comprises a throttle for the supply duct and an actuating cam for the throttle with the ability to move between an operative position (A), in which it pushes and arranges the throttle against the supply duct, flattening it locally and impeding the passage of fluid through it; and a free position (B), in which it does not arrange the throttle against the duct, thereby allowing the passage of liquid from the tank to the tear holes, the mentioned actuating cam being mounted in the proximity of the mouth and being operable in the direction of its operative position (A) upon inserting a nipple of an accessory element, separate or not from the doll, in the mouth.

In this way, as long as the nipple is inserted in the mouth of the doll, the "crying" is interrupted.

When the accessory element is an element separate from the body of the doll, it preferably takes the shape of a pacifier or a bottle.

When the accessory element is an element not separate from the doll, it is preferably the finger of a hand articulately joined to the body of the doll.

In a variation of the invention, the actuating cam is urged by elastic means tending to arrange the actuating cam in the free position (B) such that upon removing the nipple from the mouth of the doll it will "cry" naturally.

According to one embodiment, the doll is endowed with retention means prepared for keeping the actuating cam loaded in its operative position (A) overcoming the force exerted on it by the elastic means.

Preferably, the mouth comprises a receiving concavity or opening for the nipple of the accessory element and the cited retention means are arranged or formed in said receiving opening and are able to retain the cited nipple inserted enough in the receiving opening to keep the actuating cam loaded in the cited operative position (A).

Thus, the "crying" is interrupted as long as the nipple is not removed from the mouth of the doll.

The nipple can be kept plugged into the mouth through a pressure coupling. Thus, the invention envisages that the nipple has a bulge intended for snap retaining it via pressure in the receiving opening.

According to one embodiment, the actuating cam is fit into a straight guide in a sliding manner, such that it follows a straight movement between its operative (A) and free (B) positions, and vice versa.

The invention provides that the throttle be linked to a support in an articulate or guided way and that it has a first end on one side; and a second bulky end, on the other side, which is arranged between a portion of the duct to be throttled and the actuating cam, which has a lower face with a contact surface that slides over the cited actuating cam and an upper face with at least one squeezing protrusion.

In a form that is of interest, a single duct supplies fluid to the two tear holes. In this form of interest, the cited duct comprises a first end connected to the bottom of the tank; an intermediary portion upon which the throttle acts; and a second end that splits into two branches, each one connected to the tear hole of an associated eye.

In order to prevent the backward movement of the duct when the squeezing element of the throttle is pressed down in the cited duct in order to throttle it via flattening, in a variation the head of the doll has a support element inside of it for the portion of the duct upon which the throttle acts.

In a variation of the invention, the tank is refillable, connected to the outside through an anti-spill and aerating valve member that functions due to gravity.

Preferably, the valve member includes a weight that, when the doll is upright, adopts a position due to gravity such that it does not close the connecting channel connecting the tank to the outside, the same weight also being able to adopt a position in which it closes the cited connecting channel of the tank when the doll is partially or completely inverted, preventing water from spilling out of the tank.

The valve member can be can be integrated in a detachable cap that is able to be coupled to an opening provided for this purpose in the tank.

According to a characteristic of an embodiment, the device incorporates a purge system for purging the duct that connects the tank with the tear holes that comprise manual pumping means able to inject air into a circuit made up of a tube that connects to the inside of the tank.

The head preferably has a lightly beveled outside surface corresponding to the lower rim of the eye socket, directly beneath each tear hole, that makes room for a small corbel or bracket intended to break the continuity of the liquid flow expelled by the tear hole.

DETAILED DESCRIPTION OF AN EMBODIMENT

Figure 1:
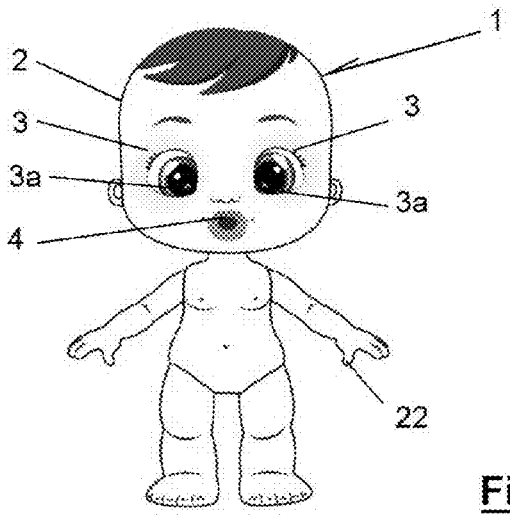
FIG. 1 shows by way of example the type of doll that can incorporate a device according to the invention.

FIG. 1 shows an example of a doll 1 adapted for the implementation of the invention. To this end the doll 1 comprises a head 2 in which two eyes 3 are provided, each one endowed with a tear hole 3*a*, and a mouth 4.

Figure 2:
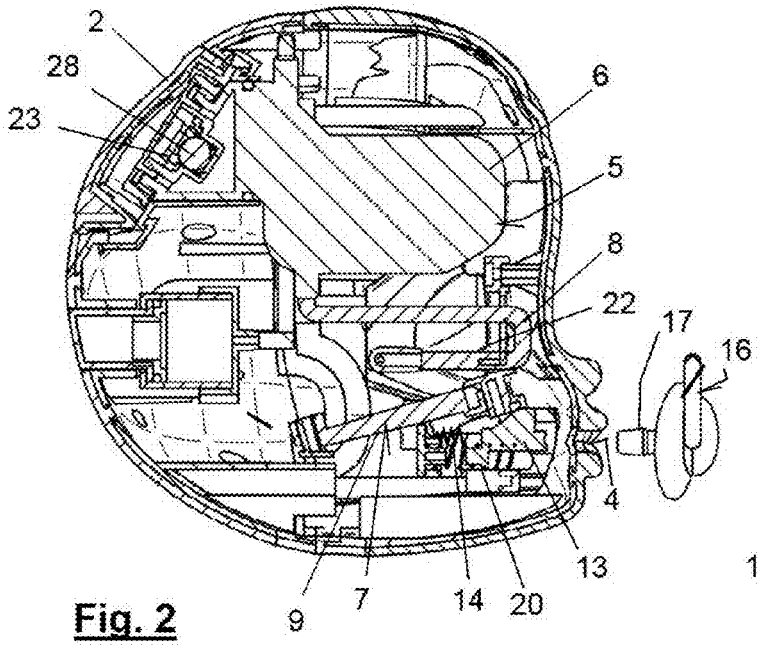
FIG. 2 schematically shows the head of a doll, such as that from FIG. 1 for example, that incorporates a device for producing the visual effect of the doll shedding tears according to the invention.
Figure 2A:
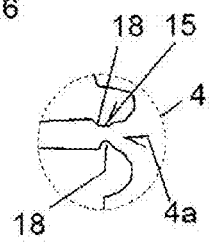
FIG. 2*a* is a detail of the mouth of the doll.

FIG. 2 shows the inside of the head 2 of the doll 1. The head 2 is made of plastic and has a series of internal dividing partitions that apart from contributing to the mechanical features of the head, for example making it rigid, carry out the function of supporting the components of a device 5 for producing the visual effect of the doll shedding tears.

This device 5 comprises a fluid tank 6, refillable with water, connected to the outside through an anti-spill valve member 23 of the kind that incorporates a weight 28 that, when the doll is upright, adopts a position due to gravity such that it does not close the connecting channel connecting the tank 6 to the outside, allowing for the entrance of air and the natural emptying of the liquid contained in the tank 6. The same weight 28 adopts a position in which the connecting channel of the tank is closed when the doll is partially or totally inverted, preventing water from spilling out of the tank.

Figure 5A:
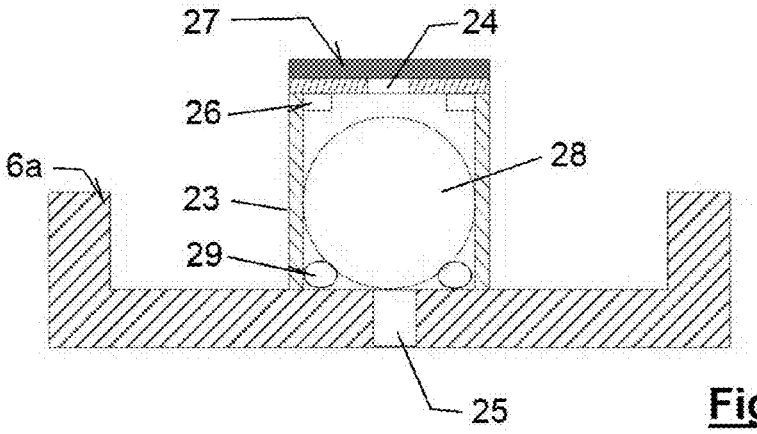
FIGS. 5*a* and 5*b* show an example of an anti-spill and aerating valve for the tank of the device, in two different positions, able to allow the tank to connect to the outside in order to allow for its natural emptying and at the same time prepared for blocking said connection and preventing unwanted pouring of the contained fluid when the doll is inverted or partially inverted.
Figure 5B:
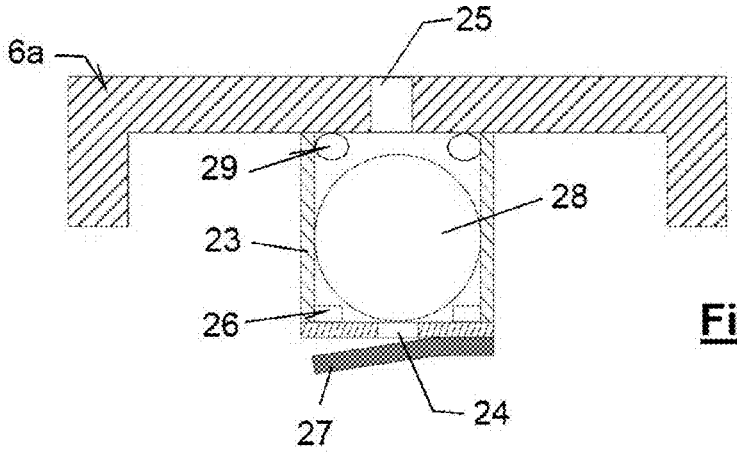
Figure 6:
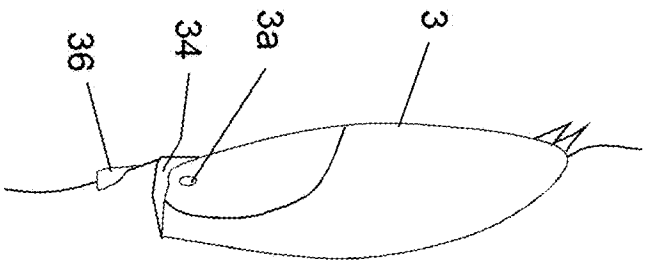
FIG. 6 shows a detail of the lower rim of the eye socket of an eye of the doll.

FIGS. 5*a* and 5*b* schematically show an example of the valve member 23 like the one previously mentioned that is mounted in a removable cap 6*a* in an opening 6*b* made in the upper end of the tank 6. The cap 6*a* can be coupled in a removable way to the opening 6*b* though known means, for example through a threaded coupling. In this way the cap 6*a* can be taken off in order to comfortably fill the tank 6.

The valve member 23 has a housing that connects, through the connecting channel 25, to the outside when the cap 6*a* is placed on the corresponding opening 6*b* in the tank 6; and also with a passage 24 that will connect the same housing with the inside of the tank 6.

The orientation of the opening 6*b* is selected such that when the doll is in an upright position or essentially upright the weight 28 rests due to the effects of gravity on a crenelated edge 26 of the passage 24 that connects to the tank 6 without preventing the passage of air in the direction of the tank, as seen in FIG. 5*b*. Upon inverting the doll, the same weight 28 also moves due to gravity until it rests tightly on a gasket 29 closing the access to the outside through the connecting channel 25 impeding in this way the outlet of fluid from the inside of the tank 6 towards the outside, as represented in this case in FIG. 5*a*.

In the example, the valve member 23 further comprises non-return means 27 whose purpose is explained later on. These non-return means 27, in the shape of a flexible membrane, are placed in the passage 24 that connects to the tank 6 and they will block it when the pressure inside the tank 6 is greater than the atmospheric pressure. Thus, the fluid contained in the tank 6 is prevented from exiting outwards, even when the doll is upright if there is a sudden increase in pressure inside the tank 6.

The device 5 comprises a supply duct 8 that is flexible and that hydraulically connects said tank 6 to the two tear holes 3*a*. Note that the location of the tank 6 is such that it is able to accumulate the fluid above the level of the tear holes 3*a* so that said fluid can be discharged naturally through these tear holes 3*a*, as long as its passage through the supply duct 8 is not interrupted.

The device 5 of the invention is prepared precisely so that the passage of the fluid in the direction of the tear holes 3*a* can be interrupted as part of the play options that the doll 1 offers. To do so, the device 5 comprises a throttle 7 for the supply duct 8 able to be actuated by an actuating cam 13 that can be activated from outside the doll 1 with the nipple 17 of an accessory element 16 of the doll 1, in the form of a pacifier in the example.

In the example of the drawings, the throttle 7, like a cantilever, is mechanically linked, preferably in a guided way and with the ability to rotate, to a support 9 provided to this end inside the head 2 of the doll 1 and in the throttle there is a first end 7*a*; and a second bulky end 7*b*, which is arranged between a portion of the duct 8 to be throttled and the actuating cam 13. In the previously mentioned bulky end 7*b* there is a lower face with a contact surface 11 that slides over the cited actuating cam 13 and an upper face with a squeezing protrusion 12 intended to flatten the supply duct 8 when the actuating cam 13 pushes up towards the throttle 7, rotating it around the support 9.

Regarding the actuating cam 13, FIG. 2 shows that in the variation of the example it fits in a sliding way in a straight guide 20, such that it can move along the guide 20 between two end positions. The throttle 7 can be mounted on this same guide 20. Nevertheless, the elastic means 14 apply stress to the actuating cam 13, tending to arrange it in the position illustrated in FIG. 2. In the example these elastic means are represented by a spring that actuates via compression but they can be configured in a different way. For example, they could be made of a tab or elastic flap that extends from the actuating cam 13 in the direction of the bottom of the guide 20.

Figure 4A:
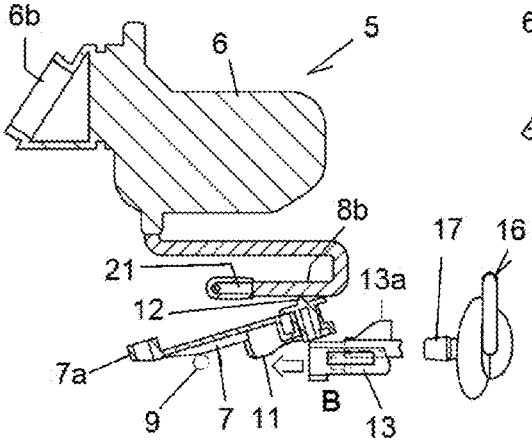
FIGS. 4*a* and 4*b* show a sequence of operations of the device.
Figure 4B:
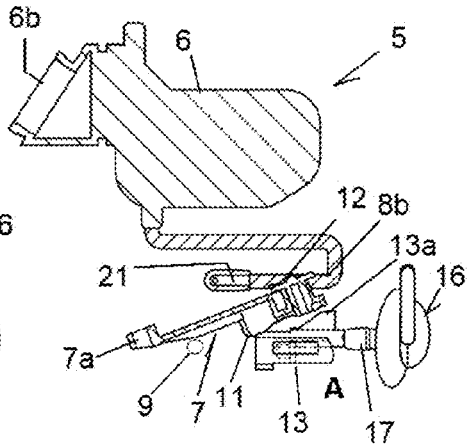

FIGS. 4*a* and 4*b* show the effect caused by the movement of the actuating cam 13 from the position illustrated in FIG. 2 towards a position in which, by touching the contact surface 11 of the throttle 7, it pushes the latter in the direction of the supply duct 8.

More specifically, FIG. 4 shows the device 5 with the actuating cam 13 in the position it adopts by default, which is a free position (B) in which it arranges the throttle 7 in a position such that the squeezing element 12 does not flatten the duct 8. In this position the fluid housed in the tank 6 has no obstacles as it flows through the duct 8 until it comes out of the tear holes 3*a*. Consequently, the doll 1 sheds tears.

As seen in FIG. 2, the actuating cam 13 is placed in the proximity of the mouth 4 of the doll 1 and specifically within reach of the nipple 17 that can be inserted into the receiving opening 4*a* formed in said mouth 4.

FIG. 4*b* shows what happens when the nipple 17 is inserted in the receiving opening 4*a*, i.e. when the pacifier is placed in the mouth 4 of the doll 1.

FIG. 4*b* shows that the nipple 17 pushes the actuating cam 13 in the direction of an operative position (A) in which said actuating cam 13 pushes the bulky end 7*b* of the throttle 7 upwards enough so that the squeezing protrusion 12 locally flattens the duct 8 impeding the passage of fluid through it. In order to prevent said duct 8 from moving back when the gripping element 12 exerts pressure on it, in the head 2 of the doll 1 a support element 22 is formed (see FIG. 2) that helps flatten the duct. Even though it is not represented, it is anticipated that this support element 22 also have some kind of protrusion or similar feature that works together with the gripping element 22 in order to encourage the throttling of the duct 8 via flattening.

When the throttle 7 adopts the position seen in FIG. 4*b*, the fluid housed in the tank 6 cannot flow through the duct 8. Consequently, the doll 1 does not shed any tears when the pacifier is placed, or in this case plugged, correctly into the receiving opening 4*a* of the mouth 4 of the doll 1.

Advantageously, upon creating an empty space in the water duct 8 downstream from the flattening, the fluid that may stay housed in the segment or segments comprised between this flattening and the connection with the tear holes 3*a* will not exit to the outside.

The invention provides that the first end 7*a* of the throttle 7, especially when the support 9 acts as a fulcrum allowing for the rotation of the throttle 7 when its second bulky end 7*b* is pushed by the actuating cam 13, be adapted for actuating the switch for the actuation of an electronic device that can be housed in another part of the doll, for example in the core of the doll 1. In this way, the instantaneous position of the throttle 7 can cause other play effects, such as the emission of a sound similar to crying or a sucking action. The invention envisages, for example, that the first end 7*a* include an electrically conductive component that closes an electric circuit upon being arranged in the suitable position for turning on the electronic device.

FIG. 2*b* shows a detail of the mouth 4 of the doll 1. Specifically, this FIG. 2*b* is useful for illustrating that the doll 1 is endowed with retention means 15 prepared for keeping the actuating cam 13 loaded in its operative position (A) (seen in FIG. 4*b*), overcoming the force exerted on it by the elastic means 14.

In the shown example, the retention means 15 are configured for retaining the nipple 17 in a plugged-in position in the receiving opening 4*a* of the mouth 4. Conventionally, these retention means act through pressure or through elastic reaction. One way to achieve this effect is to endow the nipple 17 with a bulky head 19, for example with an arrowhead shape or similar shape, and endow the receiving opening 4*a* with a ring-shaped protrusion 18 intended for retaining the bulky head of the nipple 17. During the maneuver to introduce the nipple 17 into the receiving opening 4*a*, the bulky head 19 will expand said receiving opening 4*a* or will push the ring-shaped protrusion 18 which will recover its/their natural shape when the cited bulky head 19 of the nipple 17 has moved past this ring-shaped protrusion 18, which will carry out a non-return function sufficient for overcoming the force that the elastic means 14 exert on the actuating cam 13, but suitable so that a child can take the nipple 17 out of the receiving opening 4*a* without too much effort.

The invention provides as an alternative or complement that a suitable nipple 17 for carrying out the function described previously be made in part of the same doll, such as the finger of a hand 22 of said doll 1. In this case, the tears could be interrupted by plugging the finger into the receiving opening 4*a* of the mouth 4 of the doll, imitating the habit of sucking one's thumb, which sometimes consoles babies.

Figure 3:
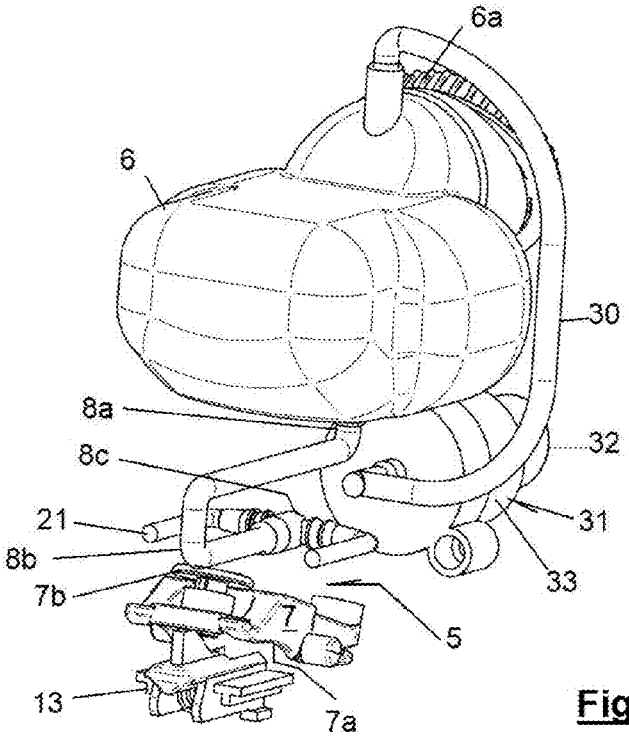
FIG. 3 is a perspective view of the device of the doll according to FIG. 2.

With the goal of having the doll 1 "cry" from both eyes 3, in a variation of the invention seen in FIG. 3 the device 5 comprises a duct 8 with a first end 8*a* connected to the bottom of the tank 6 and whose middle portion 8*b* will be acted on by the throttle 7. The duct 8 comprises a second end 8*c* that splits into two branches 21, each of which will be connected or will go through to the tear hole 3*a* of an associated eye 3. In the case of each of the branches 21 being connected with a corresponding tear hole 3*a*, the placement of an intermediary dropper is anticipated, such as a flag drip emitter, with an inlet connected to the associated branch 21 and with an outlet connected to the tear hole 3*a* with the function of obtaining a drop-by-drop flow as it exits.

With the goal of maintaining the duct 8 in the suitable position so that the gripping element 12 can find the duct 8 during the throttling maneuver, the actuating cam 13 comprises an upper flap 13*a* that impedes lateral movement by the duct 8 and that cooperates with the guide 20.

The device 5 comprises, in a preferred embodiment, a system that helps leave the doll 1 in the optimal conditions so that is creates the "crying" effect after having completed a fluid loading operation in the tank 6. The completion of a loading operation can cause air to be trapped in the tank 6.

This trapped air in the tank 6 can reach the duct 8 and cause a malfunction in the "crying", breaking the continuity of the tearing or impeding it from starting after a loading operation is completed.

In order to prevent this, the device 5 of the example incorporates a purge system 31 for purging the duct 8 that comprises conventional pumping means 33, with manual operations via a push button 32. This push button 32 is associated with a piston capable of injecting air into a circuit made up of a tube 30 that connects the chamber of the piston to the inside of the tank 6. This injected air will propel the fluid contained in the tank 6 towards the only possible outlet, which is through the duct 8 in the direction of the tear holes 3*a* in this way purging any air that may be trapped in this duct 8. Note that in order to keep this excess pressure from causing the fluid or the injected air to come out through the valve member 23, the latter has the previously described non-return means 27, as shown in FIGS. 5*a* and 5*b*.

To contribute to a more realistic "crying" effect, the doll 1 of the example has a lightly beveled outer surface corresponding to the lower rim of the eye socket, directly beneath each tear hole 3*a*, that makes room for a small corbel or bracket 34 intended to break the continuity of the liquid flow expelled by the tear hole 3*a*, contributing to the formation of drops 36 that slide down the cheeks of the doll 1.

The invention claimed is:

1. A crying doll that comprises a head in which two eyes are provided, each eye endowed with a tear hole, and a mouth; and a device housed in the head for producing the visual effect of the doll shedding tears by spilling tears from the eyes; the device comprising a fluid tank connected to the outside and able to accumulate a fluid above a level of the tear holes and at least one flexible supply duct that hydraulically connects said tank to one or to both of the tear holes; wherein the device further comprises a throttle for the supply duct and an actuating cam for the throttle with the ability to move between an operative position, in which the actuating cam pushes and arranges the throttle against the supply duct, flattening the supply duct locally and impeding the passage of fluid through the duct; and a free position, in which the actuating cam does not arrange the throttle against the duct, thereby allowing the passage of liquid from the tank to the tear holes, the actuating cam being mounted in the proximity of the mouth and being operable in the direction of the operative position upon inserting in the mouth a nipple of an accessory element, separate or not from the doll.

2. The doll according to claim 1, wherein the actuating cam is urged by elastic means, that tend to arrange the actuating cam in the free position.

3. The doll according to claim 2, wherein the doll is endowed with retention means for keeping the actuating cam loaded in the operative position overcoming the force exerted on the actuating cam by the elastic means.

4. The doll according to claim 3, wherein the mouth comprises a receiving concavity or opening for the nipple of the accessory element and the retention means are arranged or formed in said receiving opening and are able to retain the nipple inserted enough in the receiving opening to keep the actuating cam loaded in the operative position.

5. The doll according to claim 4, wherein the nipple has a bulge intended for being snap retained in the receiving opening.

6. The doll according to claim 4, wherein the nipple has a bulge for being snap retained in the receiving opening through elastic reaction of the retention means.

7. The doll according to claim 1, wherein the actuating cam is fit into a straight guide in a sliding manner, such that the actuating cam follows a straight movement between the operative and free positions, and vice versa.

8. The doll according to claim 1, wherein the throttle is linked to a support in an articulated or guided way and has a first end; and a second bulky end, which is arranged between a portion of the duct to be throttled and the actuating cam, which has a lower face with a contact surface that slides over the cited actuating cam and an upper face with at least one squeezing protrusion.

9. The doll according to claim 8, wherein the duct comprises a first end connected to a bottom of the tank; an intermediary portion upon which the throttle acts; and a second end that splits into two branches, each one connected to the tear hole of an associated eye.

10. The doll according to claim 9, wherein the head of the doll has a support element inside of the head for the intermediary portion of the duct upon which the throttle acts, which prevents the backward movement of the intermediate portion of the duct when the squeezing element of the throttle is pressed down in the duct in order to throttle the duct via flattening.

11. The doll according to claim 1, wherein the accessory element is an element separate from the body of the doll and takes the shape of a pacifier or a bottle.

12. The doll according to claim 1, wherein the accessory element is a finger of a hand articulately joined to the body of the doll.

13. The doll according to claim 1, wherein the tank is refillable, connected to the outside through an anti-spill valve member that functions due to gravity.

14. The doll according to claim 13, wherein the valve member incorporates a weight that, when the doll is upright, adopts a position due to gravity such that the weight does not close a connecting channel connecting the tank to the outside, allowing for the entrance of air and the natural emptying of the liquid contained in the tank; the same weight also being able to adopt a position in which the weight closes the connecting channel of the tank when the doll is partially or completely inverted, preventing water from spilling out of the tank.

15. The doll according to claim 14, wherein the valve member is integrated in a detachable cap that is able to be coupled to an opening provided for this purpose in the tank.

16. The doll according to claim 1, wherein the device incorporates a purge system for purging the duct that comprises manual pumping means able to inject air into a circuit made up of a tube that connects to an inside of the tank.

17. The doll according to claim 1, wherein the head has a lightly beveled outside surface corresponding to the lower rim of the eye socket, directly beneath each tear hole, that makes room for a small corbel or bracket configured to break continuity of the liquid flow expelled by the tear hole.

* * * * *